United States Patent [19]

Wood

[11] Patent Number: 4,772,991

[45] Date of Patent: Sep. 20, 1988

[54] LAMP CONSTRUCTION

[76] Inventor: Coleman Wood, 2236 Colquitt, Houston, Tex. 77098

[21] Appl. No.: 69,111

[22] Filed: Jul. 2, 1987

[51] Int. Cl.[4] ..... F21M 3/18

[52] U.S. Cl. ..... 362/287; 362/427

[58] Field of Search ..... 362/285, 287, 418, 419, 362/426, 427

[56] References Cited

U.S. PATENT DOCUMENTS

| | | | |
|---|---|---|---|
| 2,911,525 | 11/1959 | Strom | 362/418 |
| 3,790,773 | 2/1974 | Sapper | 362/426 |
| 4,652,068 | 3/1987 | Boekholt | 362/427 |

*Primary Examiner*—Carroll B. Dority, Jr.

*Attorney, Agent, or Firm*—Gunn, Lee & Jackson

[57] ABSTRACT

In a lamp, a construction is set forth including a low voltage power source including an adjustable supply to a transformer in a base wherein the transformer is connected with a pair of coextensive arms. The arms are preferably made of metal and are the conductors. The voltage level is intrinsically safe. The arms extend to remotely support a housing with a bulb therein. The housing has a pair of oppositely positioned sockets and the arm supports miniature banana plugs which stab into the sockets to provide electrical current for bulb operation and to also serve as a pivot for the housing. In addition, a greater measure of freedom is obtained by incorporating a pivot wherein the arms pivotally connect with a second pair of coextensive arms to provide an added degree of freedom.

12 Claims, 3 Drawing Sheets

FIG. 4
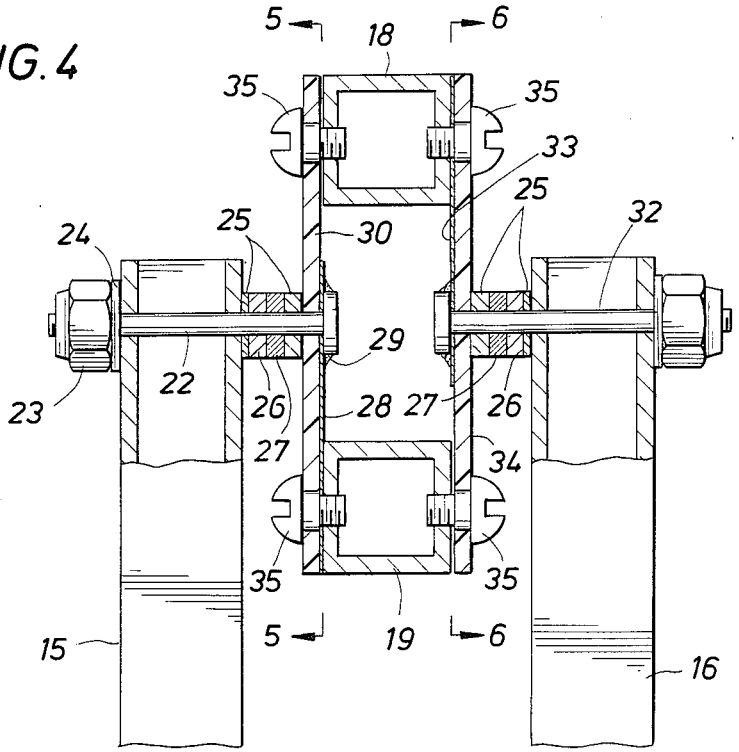
FIG. 5
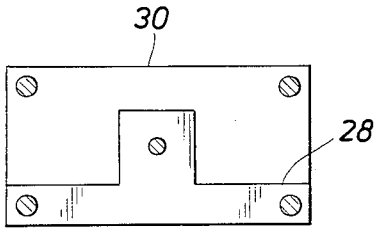
FIG. 6
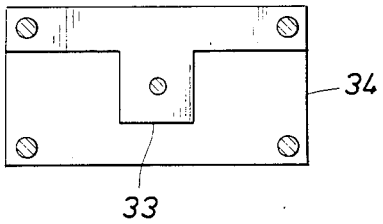
FIG. 7
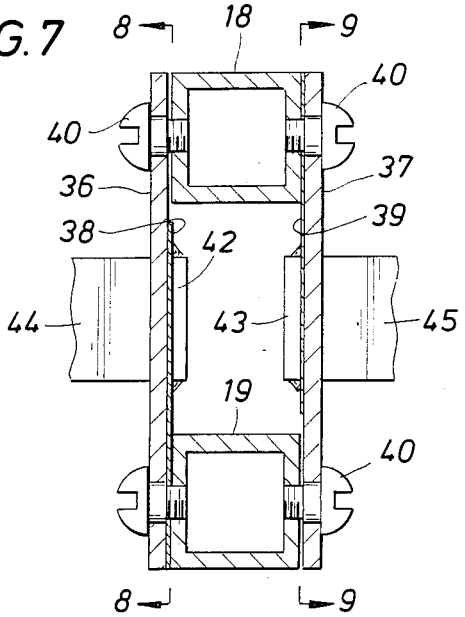
FIG. 8
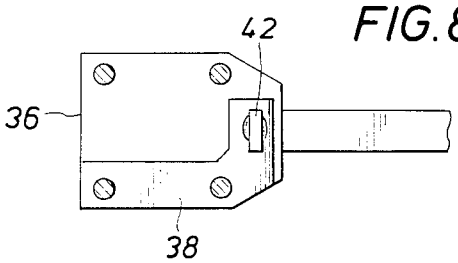
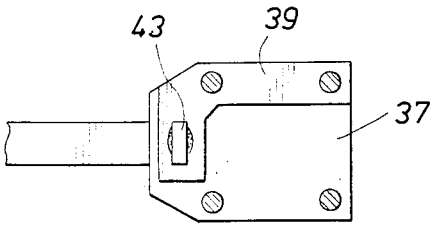
FIG. 9

LAMP CONSTRUCTION

FIELD OF THE INVENTION

This disclosure is directed to a lamp, and more importantly, a lamp utilizing a transformer which reduces the voltage from the typical line voltage of 110 V AC to a low voltage which is intrinsically safe to use and handle. This lamp construction takes advantage of the low voltage, to wit, it avoids the installation of cable conductors from the power cord up to the lamp bulb. The lamp construction thus permits the lamp to be deployed on a long thin support arm made of two parallel support members, the support members holding the lamp at a distance to permit it to be easily repositioned by the user. Repositioning is an advantage which cannot be otherwise provided should there be an electric cable extending to the lamp. Power distribution is thus accomplished by thin metal conductors affixed to the mounting arms. The power conductors would not otherwise be safe if they were conducting 110 V AC. However, at the low voltages contemplated, they are quite safe in that they operate at low voltages. Spark suppression is achieved by operation at low voltage. Ignition is not possible because the voltage is so low as to be deemed intrinsically safe.

Since the cable is omitted, a greater measure of flexibility is achieved. The lamp is suspended in a housing which in turn fastens between a pair of parallel arms, the arms extending from a base to some maneuverable elevated location.

The arms are lighter gauge than would be the case if a conductor cable system were incorporated. The arms are further deployed from one another so that they clamp the housing which supports the lamp. The housing connects with the arms by supports the lamp. The housing connects with the arms by conventional banana plugs which stab into the housing and thereby define an axis of rotation. This axis permits the housing for the lamp to rotate indefinitely without entanglement of conductors and moreover, provides current flow for operation of the lamp through a low resistance connection.

The present invention is thus summarized as a lamp construction having a base adapted to be rested on a table or fastened to a wall which supports a pair of extending arms. The two arms in turn are spaced from one another and are parallel to one another. The arms connect with the output secondary of a coupling transformer which steps down the voltage to something in the range of 12 V AC or less. This voltage is viewed as intrinsically safe in operation. The two arms extend to a pair of oppositely mounted banana plugs which connect with a housing supporting the lamp. This lamp construction is able to be rotated and pivoted. One or more pivots are arranged in the apparatus to permit proper rotation.

In one embodiment, first, second and third pivots are included to provide three degrees of freedom. Reduced flexibility can be obtained as for instance through the use of two pivots yielding two degrees of freedom. In both instances, the arms are extended through a pair of parallel members which support metal conductors of sufficiently low voltage that insulation is not required.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 4 is a detailed view along the sectional line 4—4 of FIG. 1 showing details of construction through a pivotal connection so that power is provided along two separate and insulated paths;

FIG. 5 is a sectional view along the line 5—5 of FIG. 4 showing deployment of conductive material on an arm construction;

FIG. 6 is a sectional view along the line 6—6 of FIG. 4 showing additional details of construction of the opposite arm to that of FIG. 5 wherein the two arms are connected for rotation around the same axis and yet provide insulated electrical current paths;

FIG. 7 is a detailed sectional view through the bracket supported on a pair of arms which in turn support the lamp and housing shown in FIG. 1 wherein the sectional view illustrates conductive material thereon for providing the two conductor paths for the lamp;

FIG. 8 is a sectional view along the line 8—8 of the structure shown in FIG. 7 showing the conductive coating and illustrating connection to a mounting bracket supporting the lamp and housing;

FIG. 9 is a sectional view along the line 9—9 of FIG. 7 showing additional details of construction of the opposite side of the structure shown in FIG. 7 and further illustrating the second conducting path extending to the lamp and housing;

DETAILED DESCRIPTION OF THE PREFERRED EMBODIMENT

Figures 1, 2, 3, 13:
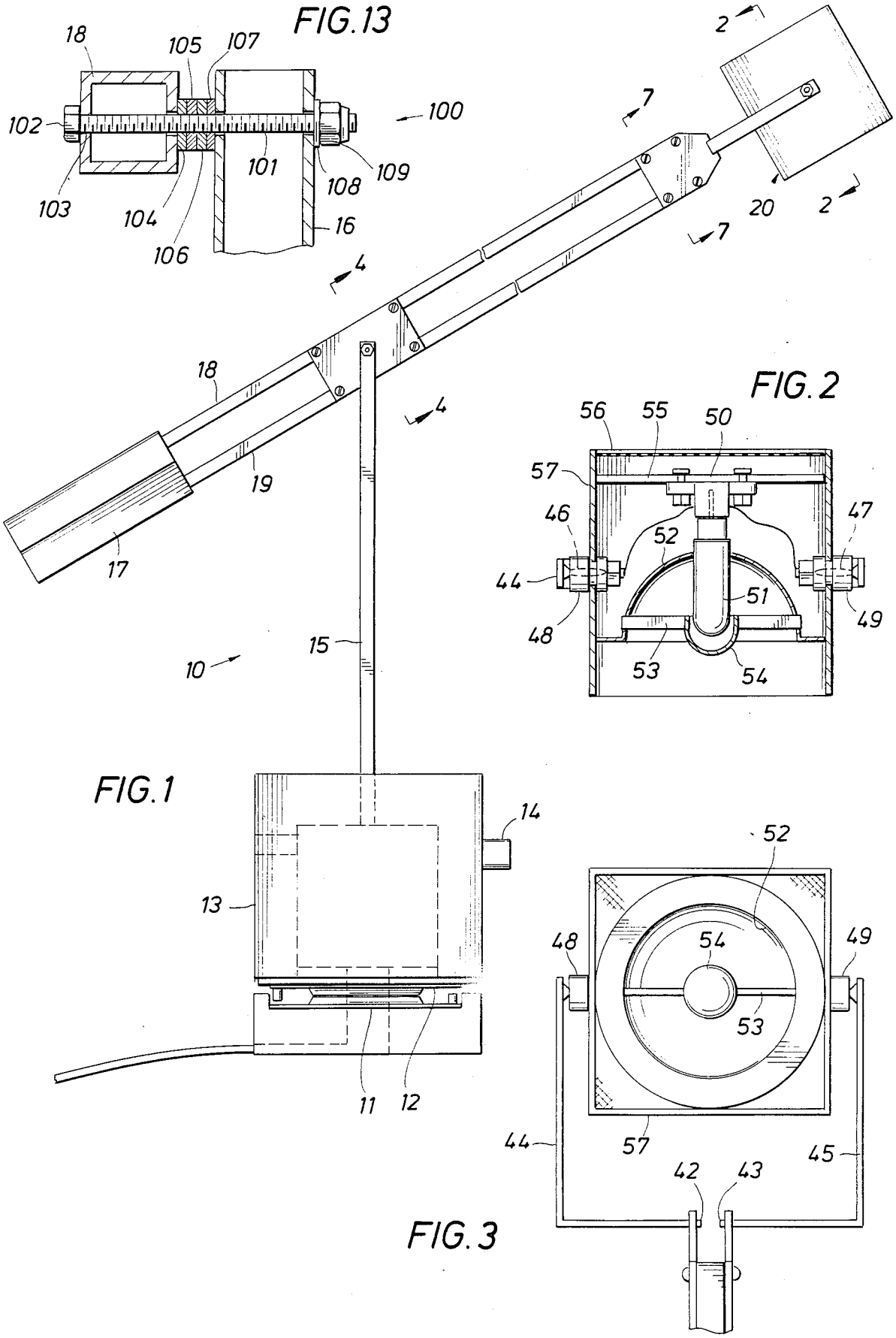
FIG. 1 is a side view of a lamp constructed in accordance with the teachings of the present disclosure and having three degrees of freedom wherein a pair of spaced arms provide electrical conductors through two pivot points connected to a lamp in a housing at the end of the apparatus.
FIG. 2 is a sectional view along the line 2—2 of FIG. 1 showing details of construction of a lamp and lamp housing and illustrating a mechanism for connecting electrical power to the lamp.
FIG. 3 is an orthogonal view to FIG. 2 showing details of construction of the lamp housing and lamp.
FIG. 13 is a sectional view through an alternate pivotal connection.

Attention is first directed to FIG. 1 of the drawings where the numeral 10 identifies a lamp constructed in accordance with the present invention. This lamp 10 will be described preceding from the base upwardly. It incorporates a bottom support plate 11 which is aligned on a center line axis for rotation of a turn table 12. The plate is received in a support receiving a power cord through a central vertical hole. A base housing 13 is supported by the turn table 12. The device includes circuitry enclosed in the housing 13. A convenient knob 14 is affixed to an adjustable potentiometer to adjust the lamp current by adjusting the lamp voltage. This changes the illumination. The structure preferably is constructed with relatively thick walls to provide some measure of weight to avoid wobbling and to enhance stability of the base. Also, air cooling is obtained through air holes in the housing 13.

The structure supports a pair of upstanding parallel arms 15 and 16. These arms are better shown in FIG. 4 which is a sectional view through the arms 15 and 16. In FIG. 1, one is obscured by the other.

Going back to FIG. 1, the arms extend upwardly to the pivotal connection which provides the second degree of freedom and is better illustrated in FIG. 4. At this location the structure includes a rotatable member which supports a counter balance weight 17 at one end, the lamp housing 20 being located at the opposite end. The relative length of the structure between the weight 17 and the housing 20 in conjunction with the relative weights achieves a balance so that the relative angular position is sustained when the lamp 10 is positioned in a particular angular position. The counter balance weight 17 is located in distance and sized in mass so that it serves as a proper counterbalance.

Continuing with FIG. 1 of the drawings, the numeral 18 identifies an upper frame member parallel to a lower frame member 19. They connect to the counter balance weight 17.

The frame members 18 and 19 are elongate rectangular members. They are preferably made of hollow stock. The upstanding arms 15 and 16 are of similar construction. A preferred material is a relatively good conducting material such as brass. Alternate materials include aluminum. Another alternate material is any plastic which is doped with a conductive material such as graphite to provide conductivity. The arms 15 and 16 are vertical while the arms 18 and 19 rotate and thus can be horizontal or extend at an angle as shown in FIG. 1. The arms 18 and 19 are spaced apart from one another by the counterweight at one end and the various brackets. The spaced pairs of arms are shown in FIG. 4. Since they are made of conductive material, they serve as conductors. Assume for purposes of description that the upstanding vertical arm 15 is positive while the return current path is through the arm 16. Assume further that the voltage applied thereon (to be discussed later) is up to about 12 V AC. The vertical arm 15 is thus made into a conductor. A bolt 22 is passed through appropriate drilled holes at the end of the arm 15. It is locked in place by a suitable locking nut 23 which contacts a friction washer 24. This assures a threaded connection which will not loosen. Electrical connection is enhanced by the use of a star lock washer 25. This lock washer 25 abuts a metal flat washer 26 to assure a good metal contact for current flow. The current flow path is through the arm 15 and into the bolt 22. The bolt 22 has a head which abuts a ply of conductive metal 28 on a bracket plate 30. The head of the bolt 22 is secured by a lock washer 25 followed by a hex nut 27 to the outside of bracket plate 30. The nut 27 assures clamping against the metal foil 28. The contact to the metal foil is sufficient to conduct current, and the nut 27 cooperating with the lock washer clamps the bolt head to obtain adequate loading to sustain contact. An option is adding a solder joint 29, if desired, to enhance contact. The current flow path is thus through the arm 15 and into the bolt 22. Because of the friction achieved by the use of the lock washers 25 and the tightness of the nut 23 on the bolt, current flow is assured along the bolt 22 to the head of bolt 22 and then to the metal ply 28.

The bracket plate 30 is made of non-conductive material such as sheet epoxy glass. One suitable arrangement is to use printed circuit board material (PCB hereinafter) so that the metal ply 28 is an isolated island on the PCB 30. In other words, the bracket 30 is cut to a particular profile and has the conductive metal on one face etched. This defines the location of the metal. The metal extends along the bracket 30 to contact the metal (conductive) member 19.

The foregoing description applies to the bolt on the left hand side of FIG. 4. The numeral 32 identifies the duplicate bolt on the right hand side. It is connected with the metal ply 33 which is on the bracket member 34. The brackets 30 and 34 are identical in shape or profile. They are both equipped with selected coating material having locations better shown in FIGS. 5 and 6. To summarize the current flow paths shown in FIG. 4, recall that one flow path is up through the arm 15. This flow path extends through the bolt 22, the metal film 28 and into the frame member 19. The other current flow path includes the upwardly extending arm 16, the bolt 32, and metal ply 33 and the frame member 18. These two current flow paths are spaced from one another and are held apart by insulating material (PCB) of the brackets 30 and 34. The structure shown in FIG. 4 further includes the screws 35 which join the brackets together.

In FIGS. 5 and 6, the conductive regions on the brackets are shown. FIG. 5 shows the bracket 30 supporting the conductive metal ply 28. FIG. 6 shows the bracket 34 which supports the conductive metal ply 33. As will be understood, both of these members are preferably made of PCB material which is patterned with a photoetch process which forms the metal islands shown in FIGS. 5 and 6.

Going now to FIG. 7 it will again be observed that the spaced metal frame members 18 and 19 are separated by opposing mounting brackets. In this instance, the brackets are identified by the numerals 36 and 37. Again, they are preferably made of PCB material. As shown in adjacent FIGS. 8 and 9, the bracket 36 has a metal layer 38 deployed in a particular region while the bracket 37 is provided with metal plating in a particular region identified at 39. Moreover, the metal layers 38 and 39 are deployed adjacent to the frame members 18 and 19 to be clamped thereagainst. To this end, the mounting brackets are joined by fastening screws 40 at the indicated locations. They are fastened into the frame members 18 and 19 to assure adequate connection.

The brackets 36 and 37 are perforated at suitable locations and conductive metal members extend therethrough. The conductive metal members incorporate upstanding tabs identified at 42 and 43 in FIGS. 8 and 9 which are in fact protrusions of the "L" shaped frame yokes 44 and 45. The tabs 42 and 43 are soldered at the opposite faces to define structures better shown in FIG. 3. In FIG. 3, an "L" shaped yoke member 44 is positioned on one side while the symmetrical yoke member 45 is on the opposite side. The two yoke members are soldered to axially aligned banana plugs 46 and 47 better shown in FIG. 2 of the drawings. The banana plugs 46 and 47 are received through insulated sockets 48 and 49. The sockets in turn have internal terminals which electrically connect with the banana plugs. In turn, they connect with electrical conductors shown in FIG. 2 which extend to a lamp base 50. The lamp base 50 is wired in the circuit and supports a bulb 51 for providing illumination. The bulb is integral to and centered in a reflector 52. The reflector directs light in the proper direction. The reflectorbulb 52 is a high intensity bulb which is mechanically protected by a transverse bar 53 supporting a cap or a protective shield 54 to assure physical security to the bulb and also to cut down on the bright spot which might otherwise blind a person momentarily. The reflector 52 directs the light out of the housing.

The lamp base 50 is supported by a transverse frame member 55. In turn, the frame member 55 is anchored in a rectangular housing having a back or end wall 56 adjacent to four side walls 57. Ideally, the several walls form a cube which is open at one face so that light may emerge from the cube. The frame members 44 and 45 are flexible sufficiently to enable the miniature banana plugs 46 and 47 to stab into the respective sockets. The housing can be dismounted. The housing is that structure generally shown in FIGS. 2 and 3. The housing encases the lamp and reflector so that light is controllably directed. The banana plugs are located along an axis approximately through the center of the cube defining the housing 20. This permits easy rotation. There is sufficient friction along the banana plugs to hold the balanced housing at any particular angle. As will be understood, the banana plugs define the third axis of rotation or the third degree of freedom for the lamp 10 shown in FIG. 1 of the drawings.

Figure 10:
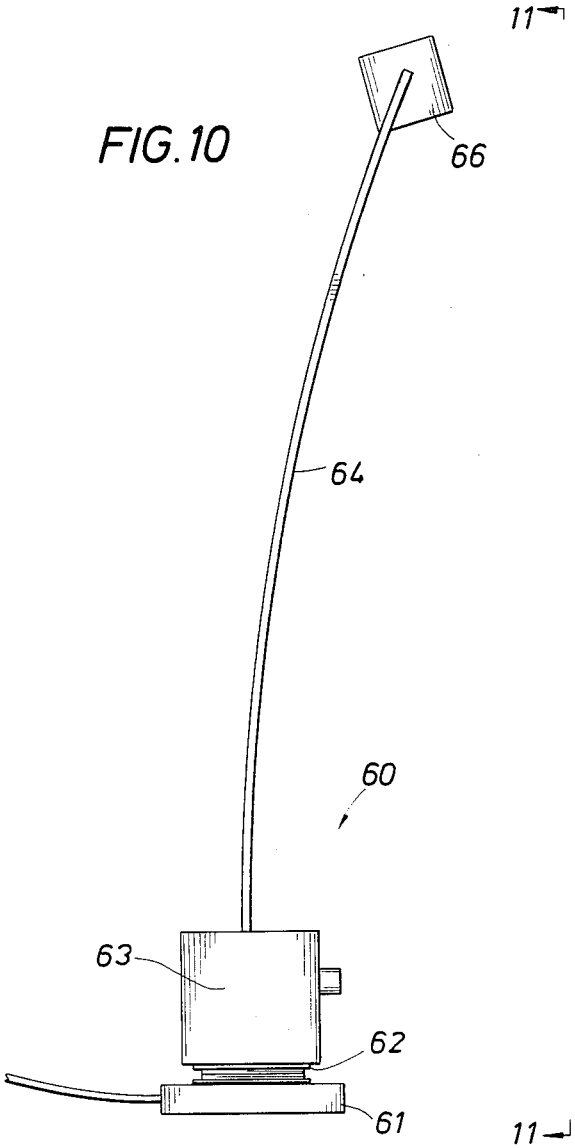
FIG. 10 is a side view of an alternate construction of the lamp of the present disclosure with a simplified support arm.
Figure 11:
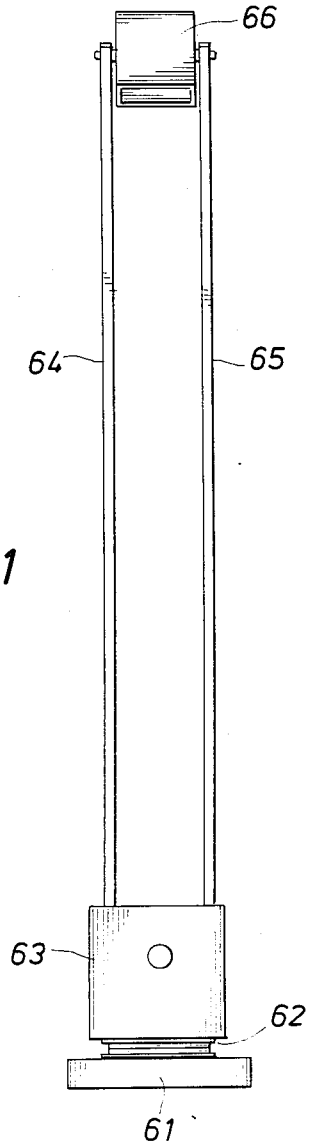
FIG. 11 is an orthogonal view of the structure shown in FIG. 10 showing the spaced parallel arms.

Going now to FIG. 10 of the drawings, an alternate embodiment is identified by the numeral 60. This embodiment incorporates a larger base 61 to assure adequate stability. It utilizes a similar turn table 62 for rotation about a first axis which is vertical to the base 61. A cabinet 63 encloses the circuitry which provides the output voltage. A pair of bent arms extend upwardly and are identified by the numerals 64 and 65. Again, the arms 64 and 65 terminate at banana plugs in the same fashion as shown in FIG. 2 and support the cube shaped housing 66 for rotation about a second axis of rotation. This yields two degrees of freedom for the embodiment 60.

Figure 12:
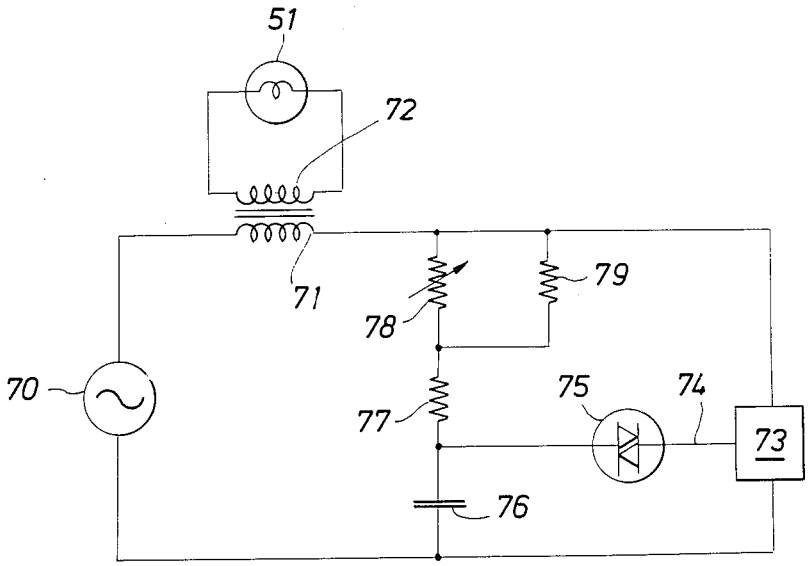
FIG. 12 is a schematic circuit diagram of a circuit which provides an adjustable reduced voltage current flow for lamp illumination.

In FIG. 12 of the drawings, a conventional voltage source is identified at 70. Typically, this is a commercial power system and connection is made by means of an extension cord or power cord to it. The numeral 71 identifies the primary of a transformer having a secondary 72. Current flow is through a triac 73. The triac is switched off and on by a signal applied to the gate thereof through a conductor 74. Switching current is controlled by a diac 75. Triggering of the diac is determined by an RC circuit. A grounded capacitor 76 connects with two series resistors 77 and 78. The resistor 78 is adjustable. Excursion of the resistance is limited by a parallel resistor 79. Thus, a suitable voltage is determined for the diac 75 which in turn triggers the triac 73. The triac is varied in operation to alter the current flow through the primary and hence through the secondary. The net effect is to provide a reduced primary voltage. The conductive cycle can be so reduced that current flow in the secondary is quite low depending on the control achieved. The variable resistor 78 can be used as a dimmer switch. It is infinitely adjustable from total darkness to full illumination. Full illumination is accomplished by adjustment to one extreme and the light is extinguished by adjustment to the other extreme. As will be understood in the operation of the diac, control voltage is achieved for each cycle of operation of the AC current applied to the system.

The current flow path should be traced; it begins at the secondary 72 and extends to the lamp 51. Thus, the secondary 72 is connected to the upstanding arms 15 and 16 shown in FIG. 1 of the drawings. The upstanding arms are provided with the intrinsically safe current flow and the current is directed along the arms up through the bracket shown in detail in FIG. 4. The current flow is then applied to the arms 18 and 19. The current flow is then directed along the arms 18 and 19 as shown in FIG. 1 to the frame members 44 and 45 in FIG. 3. Current flows through the banana plugs 46 and 47 to the lamp 51 for illumination.

Three degrees of mechanical freedom are achieved with the structure shown in FIG. 1. The provision of the counterbalance 17 enables the arms 18 and 19 to be extended horizontally so that substantial lateral reorientation is achieved.

FIG. 13 discloses an alternate pivot 100 to that of FIG. 4. A bolt 101 having a head 102 is threaded at 103 into the current conductor 18 (the frame member). The head 102 and threads 103 assure quality connection. The bolt supports four washers which are lock washers 104 and 107 while flat washers 105 and 106 are clamped therebetween. A lock washer 108 adjacent to a nut 109 assures firm metal to metal contact for a conductive path to the arm 16. The conductive path is assured by the pivotal connection 100.

While the foregoing is directed to the preferred embodiment, the scope is determined by the claims which follow.

What is claimed:

1. A lighting system providing illumination from a low voltage power source, the system comprising:

(a) a base supporting a low voltage power source;

(b) a pair of coextensive arms extending from said base and acting as electrical current carriers so that low voltage power is delivered through said coextensive arms;

(c) a second pair of coextensive arms spaced from one another;

(d) a pair of brackets joined to said second pair of arms; made of electrically non-conductive material wherein said pivot means rotationally join said first pair are connected to said first pair of arms to power source, through said first arms, through said pivot means and to said second arms.

2. The apparatus of claim 1 wherein said bracket is printed circuit board material and has conductor paths formed thereon as a metal ply affixed to a face thereof.

3. The apparatus of claim 2 wherein said first pair of arms are conductive metal and said second pair of arms are conductive metal.

4. The apparatus of claim 3 wherein said bracket comprises a pair of spaced sheet insulators.

5. The apparatus of claim 4 wherein said spaced sheet insulator members are bolted to said first and second pairs of arms.

6. The apparatus of claim 5 wherein said pivot means comprise electrically conductive members extending from said bracket means.

7. The structure of claim 2 including a generally square housing a bulb in said housing wherein said housing includes means for directing light from said housing;

8. The apparatus of claim 7 wherein said housing incorporates an internal mounting plate supporting a lamp base adapted to receive said bulb therein, and said base and bulb are positioned relative to a light reflector in said housing to direct light out of said housing from said bulb.

9. The apparatus of claim 8 wherein said housing has an open side and a parallel back side positioning in said light reflector to direct light out of said housing.

10. The apparatus of claim 9 wherein said housing has a surrounding wall between said open side and closed side and said surrounding wall supports said two pivot means opposite of one another on a pair of L-shaped mounting brackets appended to the end of said arms.

11. The application of claim 10 wherein said mounting brackets are insulated electrically to define two separate current flow paths for said bulb.

12. The apparatus of claim 1 wherein said pivot means includes:

(a) an end portion of a first arm of said first pair of arms;

(b) an end portion of a first arm of said second pair of arms;

(c) conductive metal contacting areas on said arm end portions; and (d) bolt and cooperative threaded nut means clamping said end portions to one of said brackets to create an electrical pathway therethrough.

* * * * *